US005120921A

United States Patent [19]

DiMarco et al.

[11] Patent Number: 5,120,921

[45] Date of Patent: Jun. 9, 1992

[54] CIRCUIT BREAKER INCLUDING IMPROVED HANDLE INDICATION OF CONTACT POSITION

[75] Inventors: Bernard DiMarco, Lilburn; Rodney C. Kramer, Snellville; Bruce D. Guiney, Tucker, all of Ga.

[73] Assignee: Siemens Energy & Automation, Inc., Alpharetta, Ga.

[21] Appl. No.: 589,121

[22] Filed: Sep. 27, 1990

[51] Int. Cl.[5] ..... H01H 5/06

[52] U.S. Cl. ..... 200/401

[58] Field of Search ..... 200/401, DIG. 42

[56] References Cited

U.S. PATENT DOCUMENTS 4,165,453 8/1979 Hennemann ..... 200/401
4,368,444 1/1983 Preuss et al. ..... 200/401 X
4,546,224 10/1985 Mostosi ..... 200/401
4,829,147 5/1989 Schiefen et al. ..... 200/17 R
4,951,019 8/1990 Gula ..... 335/166

*Primary Examiner*—Renee S. Luebke
*Attorney, Agent, or Firm*—James G. Morrow

[57] ABSTRACT

A circuit breaker including a contact operating mechanism configured to prevent the switch handle of the circuit breaker from being placed in an OFF position when the contacts are not separable. In addition to the switch handle, the mechanism is operable with a tripping circuit which actuates the mechanism to urge the contacts apart when the current flowing through the circuit breaker exceeds the preset limits of the circuit breaker. When the contacts are not separable and the tripping circuit actuates the mechanism, the operating handle is restricted from being placed in the OFF position, thereby avoiding the possibility of indicating an incorrect position of the contacts.

21 Claims, 3 Drawing Sheets

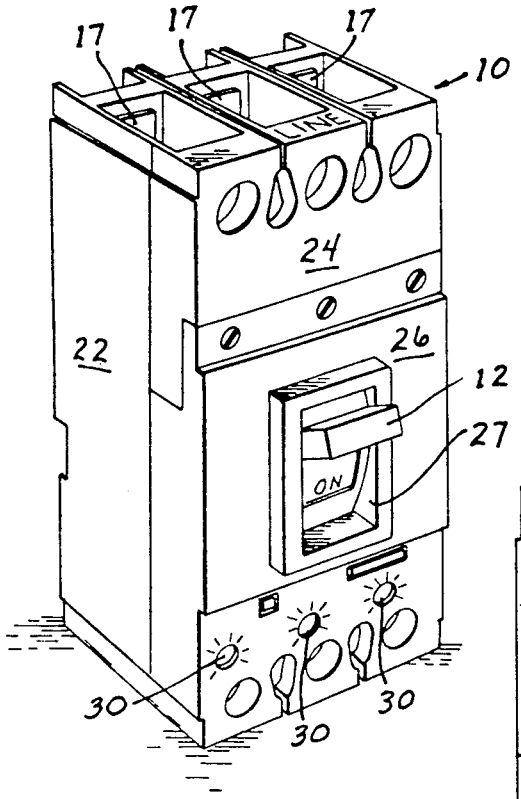
FIG. 1
FIG. 2
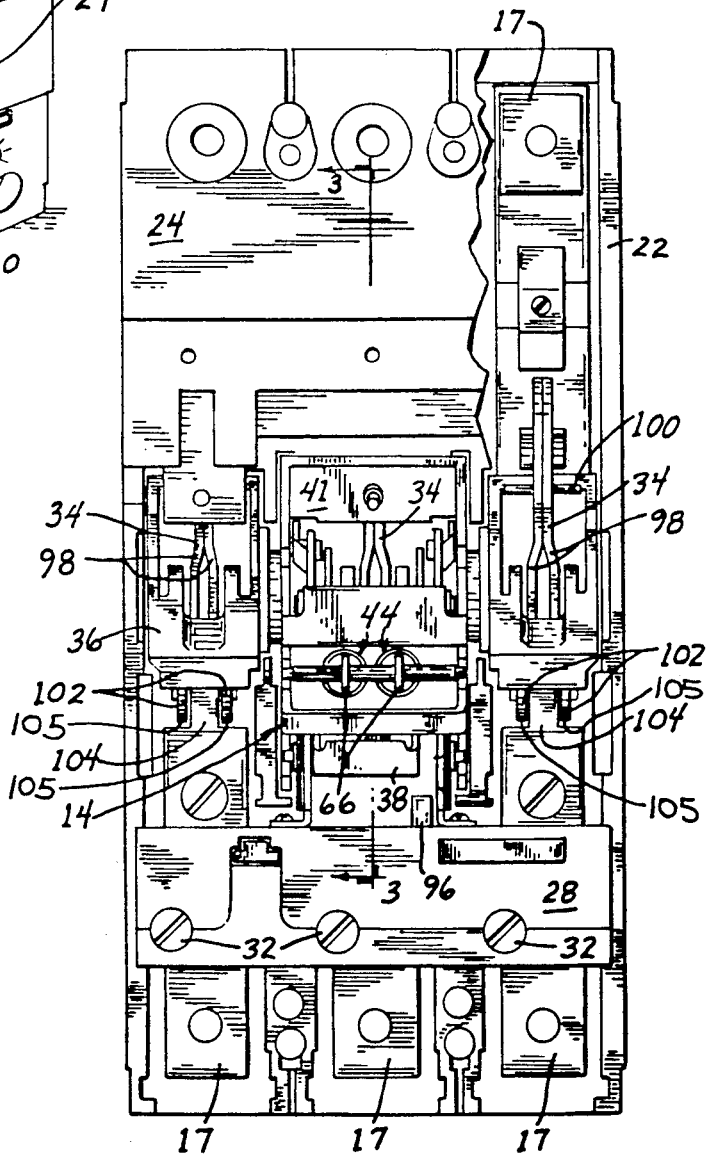
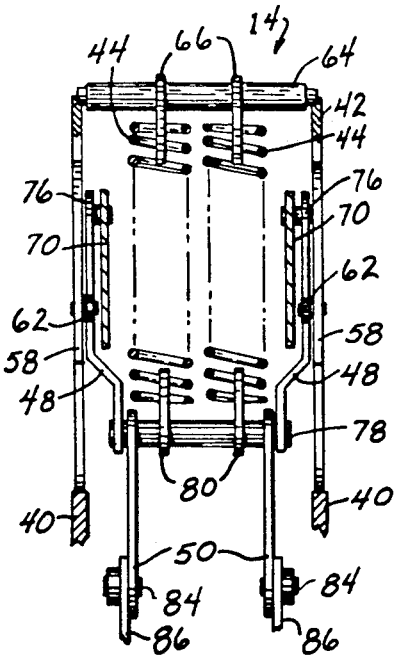
FIG. 7

CIRCUIT BREAKER INCLUDING IMPROVED HANDLE INDICATION OF CONTACT POSITION

BACKGROUND OF THE INVENTION

This invention relates to a circuit breaker, and more particularly, to a circuit breaker which prevents the circuit breaker operating handle from being positioned in an OFF position if the operating contacts of the circuit breaker are not separated.

In general the function of a circuit breaker is to electrically engage and disengage a selected circuit from an electrical power supply. This function occurs by engaging and disengaging a pair of operating contacts for each phase of the circuit breaker. Typically, one of each pair of the operating contacts are supported by a pivoting contact arm while the other operating contact is substantially stationary. The contact arm is pivoted by an operating mechanism such that the movable contact supported by the contact arm can be engaged and disengaged from the stationary contact.

There are two modes by which the operating mechanism for the circuit breaker can disengage the operating contacts: the circuit breaker operating handle can be used to activate the operating mechanism; or a tripping mechanism, responsive to unacceptable levels of current carried by the circuit breaker, can be used to activate the operating mechanism. For many circuit breakers, the operating handle is coupled to the operating mechanism such that when the tripping mechanism activates the operating mechanism to separate the contacts, the operating handle moves to a FAULT position.

To engage the operating contacts of the circuit breaker, the circuit breaker operating handle is used to activate the operating mechanism such that the movable contact(s) engage the stationary contact(s).

The present invention is directed to the rare occasion when one or more pairs of operating contacts become inseparable during operation. In a typical circuit breaker, it is possible that when the operating contacts become inseparable, the operating handle of the circuit breaker can be moved to the OFF position even though the operating contacts are not separated. When the operating contacts become inseparable, it is also possible that the level of current flowing through the circuit breaker may cause the tripping mechanism to activate the operating mechanism such that the operating handle can be moved to the OFF position without separating the operating contacts. Accordingly, even though the contacts are engaged and carrying current, the operating handle can be locked in the OFF position to indicate that the circuit breaker is OFF.

U.S. Pat. No. 4,829,147 (Schiefen et al.) relates to a circuit breaker that positively indicates the position of the circuit breaker contacts. In the apparatus of U.S. Pat. No. 4,829,147, when the contacts are locked and an operator attempts to move the operating handle to the OFF position, a shuttle pivoted on the circuit breaker operating mechanism rotates to block the movement of the handle to the OFF position.

BRIEF DESCRIPTION OF THE INVENTION

The circuit breaker of the present invention includes a circuit breaker housing, a first terminal, a second terminal, a first stationary contact electrically coupled to the first terminal, a first movable contact electrically coupled to the second terminal, a first link including a first end and a second end, a second link including a third end and a fourth end, a pivoting member movable between an ON position and an OFF position, and an elastic element. The first end is pivotable about a first pivot, the second end is rotatably connected to the third end, and the fourth end is pivotably coupled to the movable contact. The elastic element is coupled to the pivoting member and the second end such that the movable contact engages the stationary contact when the pivoting member is in the ON position and the movable contact is separated from the stationary contact when the pivoting member is in the OFF position. The improvement to the circuit breaker includes means for limiting rotation of the pivoting member relative to the first link when the first movable contact is restricted from separating from the first stationary contact. This restricted movement of the pivoting member prevents the handle mechanism from moving to the OFF position when the movable and stationary contacts will not separate.

BRIEF DESCRIPTION OF THE DRAWINGS

The preferred exemplary embodiment of the present invention will hereinafter be described in conjunction with the appended Figures, wherein like designations denote like elements, and:

FIG. 1 is a perspective view of a molded case circuit breaker;

FIG. 2 is a top view of the molded case circuit breaker with portions of the circuit breaker covers removed;

FIG. 7 is a partial end view of the operating mechanism.

DETAILED DESCRIPTION OF THE PREFERRED EXEMPLARY EMBODIMENT OF THE INVENTION

Figure 3:
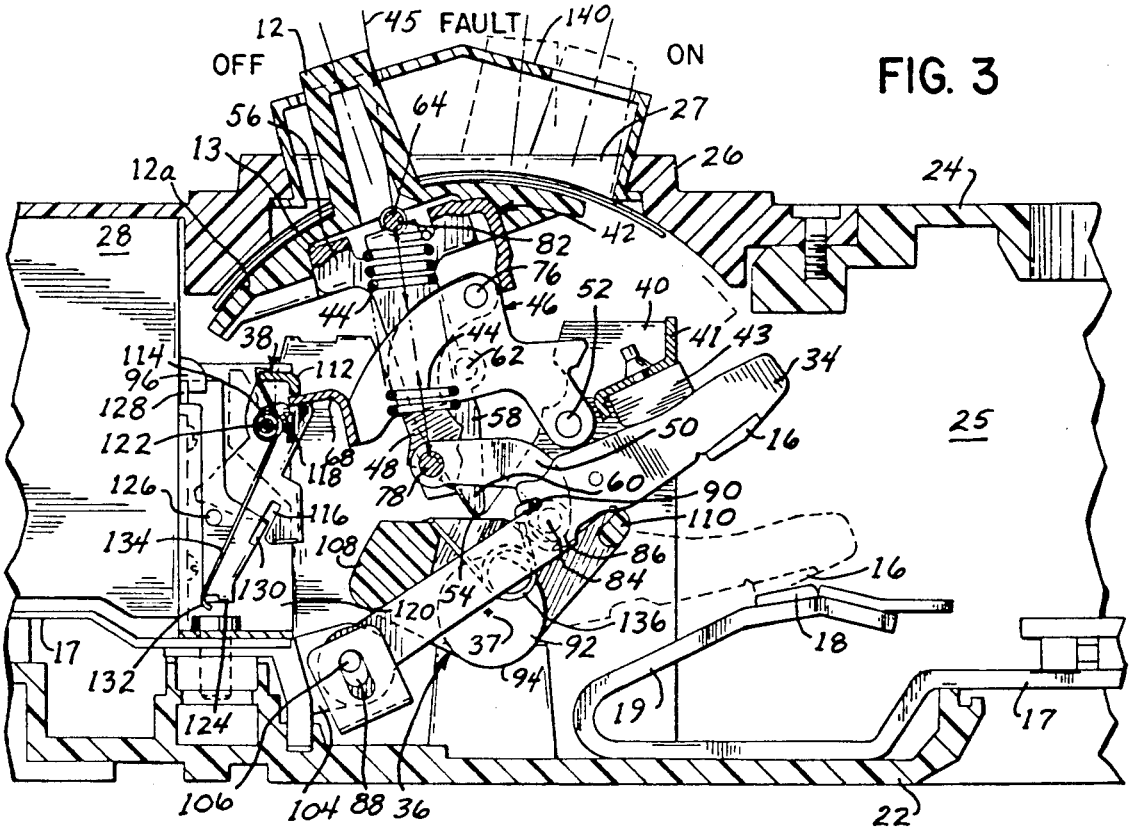
FIG. 3 is a sectional view taken along line 3—3 of FIG. 2.

FIG. 1 generally illustrates a three phase molded case circuit breaker 10 of the type which includes an operating handle 12 which is operable between an ON, OFF and TRIPPED position. Referring to FIG. 2, handle 12 is operable between the ON and OFF positions to enable a contact operating mechanism 14 to engage and disengage a movable contact 16 and a stationary contact 18 for each of the three phases, such that the terminals 17 of each phase can be electrically connected. The circuit breaker housing includes three portions which are molded from an insulating material. These portions include a circuit breaker base 22, an arc chamber cover 24, and mechanism cover 26.

In FIG. 2 mechanism cover 26 is removed and a portion of arc chamber cover 24 is broken away to show the operational elements of circuit breaker 10. In general, these elements include contact operating mechanism 14, three pivoting contact arms 34, a rotatable cross bar 36, tripping unit 28, and spring biased latch 38.

The moving components of the circuit breaker are supported by the circuit breaker base 22 as discussed below. As best seen in FIGS. 3-6, arc chamber cover 24 cooperates with base 22 to provide an arc chamber 25 and enclosure for contacts 16, 18. Mechanism cover 26 provides an opening 27 through which handle 12 passes, and cooperates with base 22 to enclose operating mechanism 14 and a tripping unit 28. Three openings 30 (FIG. 1), which each allow access to a tripping adjustment 32 (FIG. 2) on tripping unit 28 for each phase of circuit breaker 10, are provided in cover 26. Covers 24 and 26 are fastened to base 22, as shown in FIG. 1, with screws for engaging the base.

Handle 12 is integral to curved member 12*a* which includes an aperture 13 adapted to receive operating mechanism 14. Member 12*a* is configured, as shown in FIGS. 3-6, to be held between operating mechanism 14 and cover 26 such that it slides along the lower surface 23 of cover 26 when moved between the ON, OFF and TRIPPED positions. The upper surface of curved member 12*a* is provided with indicia which, when viewed through opening 27 (as in FIG. 1), indicates the position of handle 12.

Referring to FIGS. 3-7, operating mechanism 14 includes a pair of spaced side frames 40, a handle arm 42 carrying a pair of springs 44, a cradle 46, a pair of intermediate links 48, and a pair of cross-bar links 50. By way of example only, the components of operating mechanism 14 can be fabricated from a suitable steel.

Cradle 46 is pivotally connected to side frames 40 via pivot pins 52. Side frames 40 are attached together in a spaced side-by-side relationship by stop support 41 in a known interlocking tongue and groove arrangement (not shown). Stop support 41 includes a rubber contact arm stop 43 for limiting the counter-clockwise rotation of the center contact arm 34 when contacts 16 and 18 are disengaged.

A pair of spaced parallel side arms 58 extending downward from top assembly 56 of handle arm 42 have distal ends 60 thereof terminating as a pivot point abutting saddle 54, permitting each side arm to pivot against saddles 54. Each side arm also includes an interference pin 62 which can take the form of a stud pressed into an opening located between top assembly 56 and point 60. Top assembly 56 supports a spring carrier shaft 64 which passes through the top hook portions 66 of springs 44.

Cradle 46 includes a latch portion 68 and a pair of arms 70 extending therefrom. The ends 72 of arms 70 are pivotally attached with pivot pins 52 to the side frames 40. Pivot pin 76 is provided in each arms 70 to pivotally attach each arm 70 to one intermediate link 48.

Each intermediate link 48 is pivotally attached to one end of one cross-bar link 50 by a shaft 78. Shaft 78 also passes through the bottom hook portions 80 of springs 44 such that when the operating mechanism 14 is assembled with springs 44 being pre-tensioned, spring carrier shaft 64 is held in grooves 82 cut into top assembly 56.

The other end of each cross-bar links 50 each include a pivot pin 84 which pivotally attaches cross-bar link 50 to one of the clevises 86 of cross-bar 36.

Each contact arm 34 includes a pair of plates 98 including an opening 88 at the first end of arm 34, a spring engagement slot 90 located at about the midpoint of arm 34, one movable contact 16 fixed at the second end of arm 34, and two half portions 98. Plates 98 are brazed together in a side-by-side relationship as shown in FIG. 2, and movable contact 16 is brazed to both plates 98 at the second end of arm 34. Furthermore, at the first end of arm 34, plates 98 diverge to define a pair of support arms 102.

Pivot support arms 102 are adapted to receive a pivot support 104 tightly therebetween to provide two electrical contact locations 105 between each arm 102 and pivot support 104. A pivot pin 106 passes through half portions 98 and pivot support 104 to pivotally attach contact arms 102 and pivot support 104. Pivot support 104 is fastened to base 22 and one terminal 17. This arrangement provides a contact arm pivot joint which has increased current carrying capacity due to the provision of two electrical contact locations 105 for each contact arm 34.

Each stationary contact 18 may be rigidly mounted to base 22 and coupled to one terminal 17 by a U-shaped member 19. Member 19 can also be modified to mount contact 18 in a resilient manner.

As illustrated in either FIGS. 3-6, cross bar 36 includes a shaft portion 92 which is rotatably supported by bearing surface 94 such that cross-bar 36 can rotate about its axis 37. Shaft portion 92 is held in contact with bearing surface 94 by side frames 40 of base 22 such that cross bar 36 can be rotated about its axis 37. Cross bar 36 further includes three spring engagement portions 108, a contact arm engagement portion 110, and a pair of clevises 86.

Tripping unit 28 is of the type which operates by sensing the current in each phase of circuit breaker 10. When a fault or overload is sensed by tripping unit 28, a trip signal causes the unit to operate a latch 96. Tripping adjustment 32 allows adjustment of the sensitivity of tripping unit 28 to overload conditions. By way of example only, the tripping unit which can be used is an ITE Circuit Breaker Trip Unit having catalog no. FD63T250.

Spring biased latch 38 includes a latch portion 112, and a pair of side members 114. Side members 114 each include a pivot slot 118, and one of members 114 includes engagement slot 116. Latch 38 is pivotally supported by a pair of support walls 120 and a shaft 122 fixed between walls 120. Shaft 122 passes through pivot slots 118 such that latch 38 can pivot about shaft 122 and also move relative to shaft 122 along slots 118.

An engagement link 124 is also pivotally attached to one of support walls 120 with a pivot pin 126. Engagement link 124 includes a first tab 128, a second tab 130 and a spring tab 132. The first tab 128 is engagable by latch 96 of trip unit 28 and the second tab 130 is engagable with engagement slot 116. Spring tab 132 engages a coil spring 134 mounted on shaft 122 and engaged with latch 38. Referring to FIG. 3, coil spring 134 biases latch 38 in a clockwise direction, and also biases engagement link 124 in a counter-clockwise direction.

OPERATION

Referring to FIG. 3, FIG. 3 illustrates a first state of circuit breaker 10 wherein handle 12 has been moved to the OFF position to either disengage contacts 16 and 18 or to reset operating mechanism 14 so that contacts 16 and 18 can be engaged when handle 12 is moved to the ON position. In this state:

- latch 96 is engaged with first tab 128 such that engagement link 124 can not pivot about pivot pin 126;
- second tab 130 is engaged with slot 116 such that latch 38 cannot pivot about, or move relative to, shaft 122; and latch portion 68 is engaged with latch 38 such that cradle 46 can not pivot about pivot pins 52.

In the first state, when handle 12 is moved to the ON position, handle arm will pivot clockwise about pivot point 60 such that when the longitudinal axes 45 of springs 44 cross the center of pivot pin 76, intermediate links 48 toggle counter-clockwise about pivot pin 76. When intermediate links 48 toggle, links 48 rotate cross-bar links 50 clockwise about pivot pins 84 to rotate cross-bar 36 clockwise about its axis 37. This rotation compresses springs 136 between spring engagement portion 108 and contact arms 34 at engagement slots 90. The compression of springs 136 forces contact arms 34 to rotate clockwise and engage contacts 16 and 18.

When contacts 16 and 18 are disengaged by moving the handle 12 from the ON to the OFF position, handle arm 42 will pivot counter-clockwise about pivot point 60 such that when the longitudinal axes 45 of springs 44 cross back over the center of pivot pin 76, intermediate links 48 toggle clockwise about pivot pin 76. When intermediate links 48 toggle, cross-bar links 50 rotate counter-clockwise about pivot pins 84 to rotate cross-bar 36 counter-clockwise about its axis 37. This rotation allows springs 136 to decompress and contact arm engagement portions 110 to engage the bottoms of contact arms 34 such that contact arms 34 rotate clockwise to disengage contacts 16 and 18.

Figure 4:
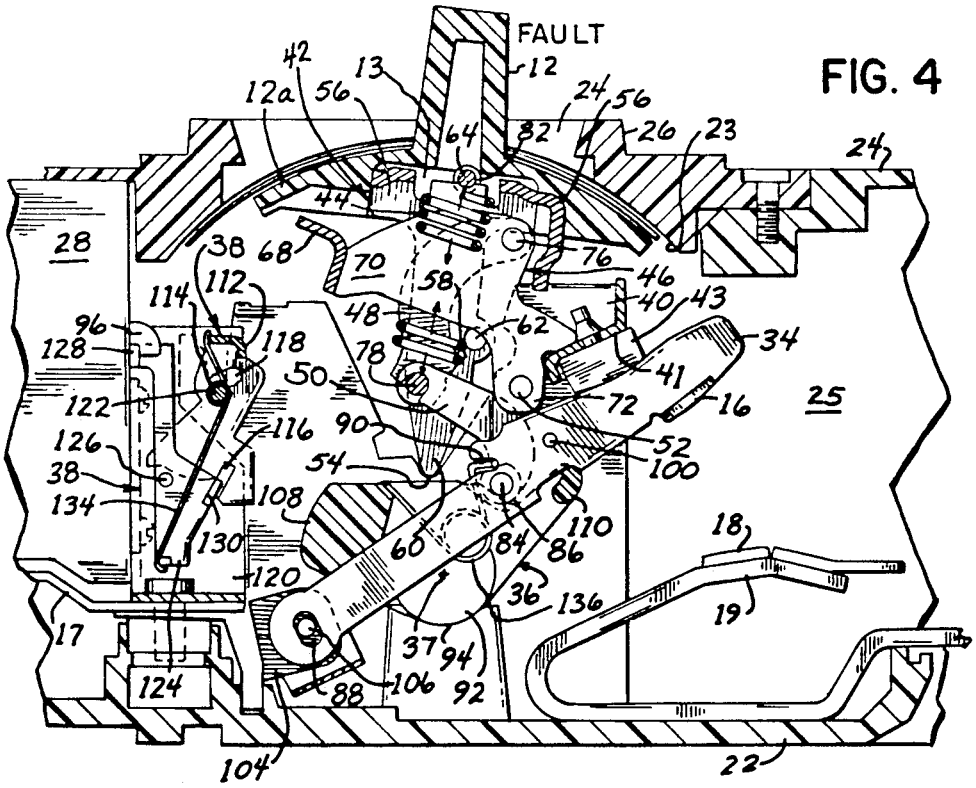
FIG. 4 is a modification of FIG. 3 wherein the operational elements are oriented different from FIG. 3.

When handle 12 is in the ON position and contacts 16 and 18 are engaged, contacts 16 and 18 can also be disengaged through the operation of trip unit 28. When trip unit 28 operates due to an overload or short circuit on one of the three phases, latch 96 disengages first tab 128 of engagement link 124 such that engagement link 124 is permitted to rotate clockwise about pivot pin 126. In response, latch 38 is pivoted about shaft 122 such that latch 38 disengages latch portion 68 of cradle 46. Upon disengagement, springs 44 urge cradle 46 to rotate clockwise causing the center of pivot pin 76 to cross axes 45 of springs 44. When pivot pin 76 crosses axes 45, circuit breaker 10 assumes a second state, as illustrated in FIG. 4, wherein:

- contacts 16 and 18 are disengaged;
- handle 12 is in the FAULT position;
- latch portion 68 of cradle 46 is disengaged from latch portion 112 of latch 38;
- contact arms 34 are bearing against contact arm stops 43;
- intermediate links 48 are being urged clockwise about pivot pins 76 by the tension in springs 44; and
- cross bar links are being urged clockwise about pivot pins 84 by the tension in springs 44.

Figure 5:
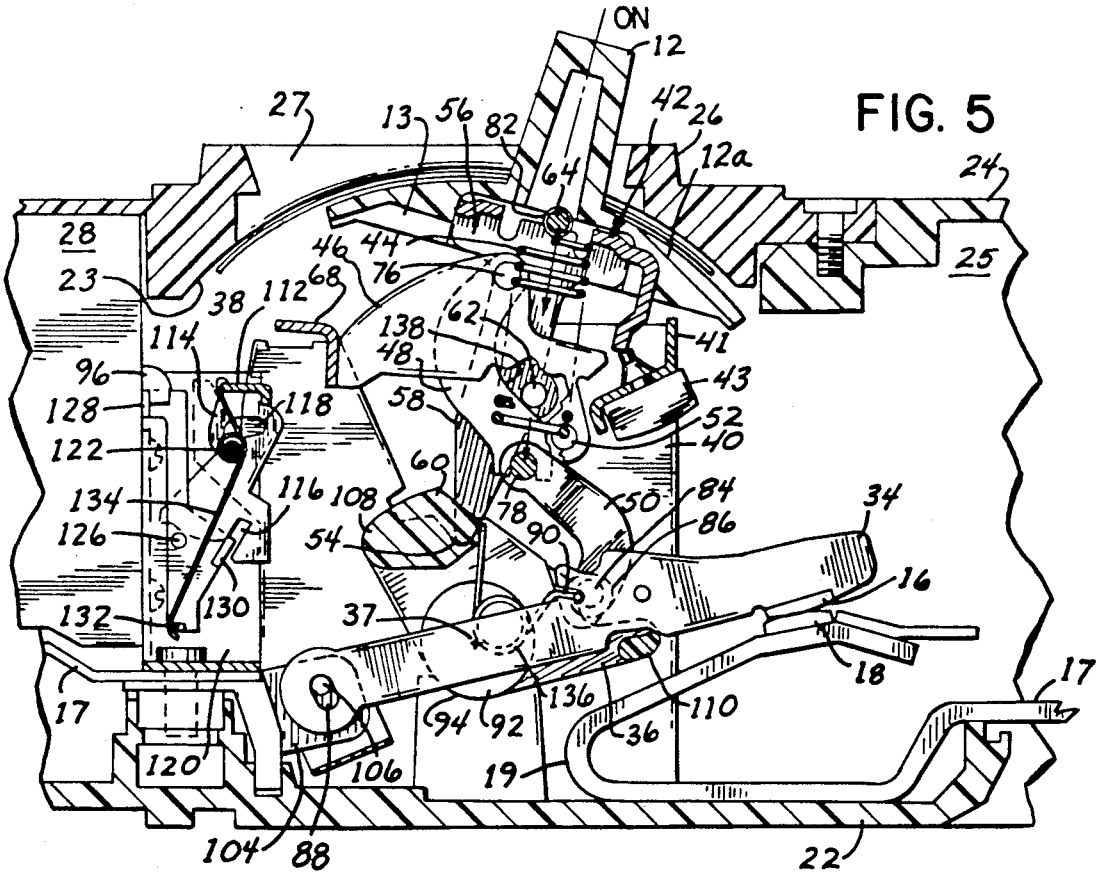
FIG. 5 is another modification of FIG. 3 wherein the operational elements are oriented different from FIG. 3.

FIG. 5 illustrates a third state of circuit breaker 10, wherein contacts 16 and 18 of one or more phases of circuit breaker 10 are not separable and trip unit 28 has operated, as discussed above, to cause latch 38 to disengages latch portion 68 of cradle 46. In this state:

- contacts 16 and 18 are engaged;
- handle 12 remains in the ON position;
- latch portion 68 of cradle 46 is disengaged from latch portion 112 of latch 38; and
- contact arm engagement portions 110 are engaged with the bottoms of contact arms 34 to prevent the cross-bar 36 from rotating counter-clockwise such that pivot pins 84 are restricted from being moved.

Figure 6:
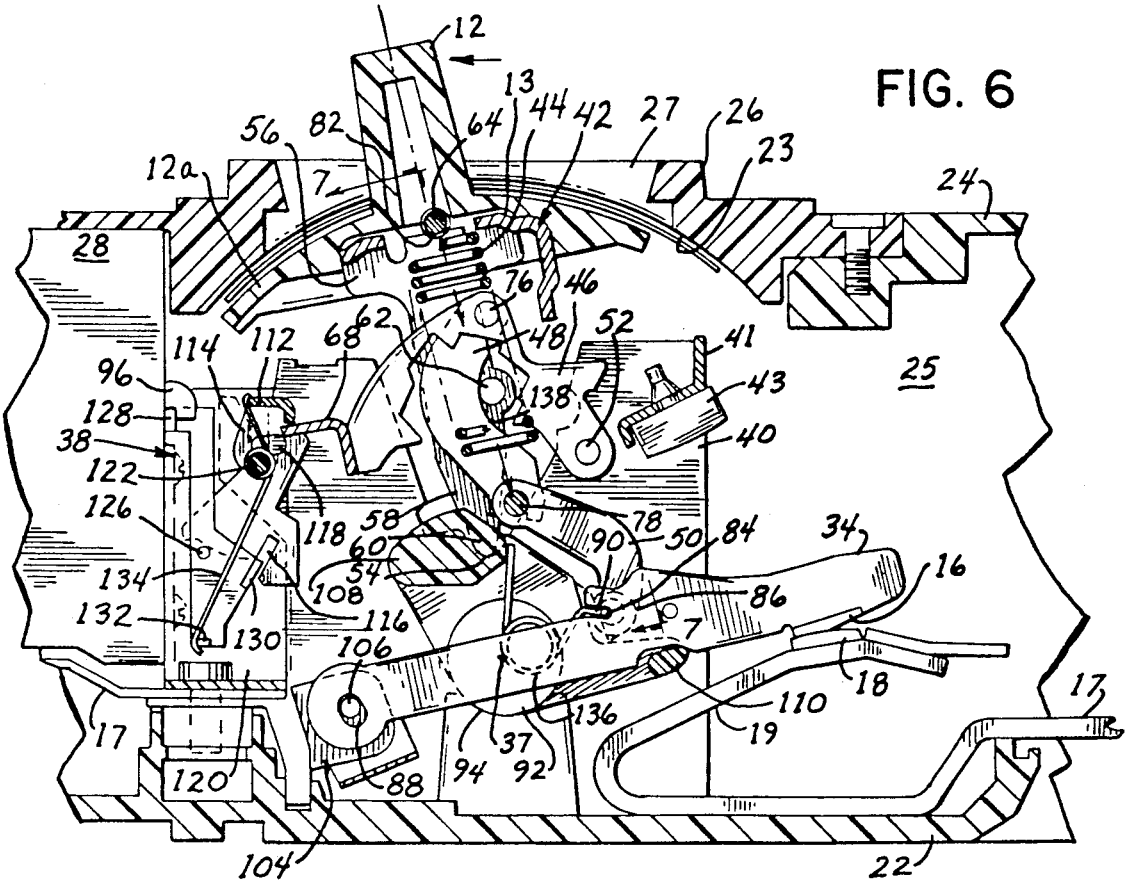
FIG. 6 is another modification of FIG. 3 wherein the operational elements are oriented different from FIG. 3.

Referring to FIG. 6, FIG. 6 illustrates the interaction between interference pins 62 and intermediate links 48 which prevents handle arm 42 from being pivoted such that handle 12 can be placed in the OFF position.

When an attempt is made to move handle 12 from the ON position (FIG. 5) to the OFF position when contacts 16 and 18 of one or more phases are not separable, handle arm 42 is rotated counter-clockwise about pivot points 60. As handle arm 42 is rotated against the force needed to extend springs 44 between spring carrier shaft 64 and shaft 78, cross-bar links 50 rotate counter-clockwise about pivot pins 84, cradle 46 rotates counter-clockwise about pivot pins 52, and intermediate links 48 rotate clockwise relative to cross-bar links 50 about shaft 78 until interference pins 62 contact surfaces 138 of intermediate links 48.

The handle 12 is restricted from moving toward the OFF position after the handle 12 has reached its stop location (FIG. 6) at which interference pins 62 contact surfaces 138. This restricted movement is the result of limitations placed upon the movement of shaft 78 and pivot pins 76 when contacts 16 and 18 become inseparable. More specifically, at the stop location, shaft 78 is fixed from moving further due to links 50 being fixed at pin 84. Accordingly, since pivot pins 52 are fixed from moving by side frames 40, pivot pins 76 are restricted from further movement since the distance between pins 52 and 76 cannot increase and the distance between shaft 78 and pivot pins 76 cannot decrease.

With pivot pins 76 and shaft 78 fixed in place at the stop location, intermediate links 48 are fixed in place and interference pins 62 are fixed in place against the contact surfaces 138. As a result, handle arm 42 and handle 12 are stopped from further counter-clockwise rotation about pivot point 60. Furthermore, a device 140, as illustrated in FIG. 3, for maintaining handle 12 in the OFF position cannot be installed since devices of this type will not engage a circuit breaker handle unless the handle is completely in the OFF position. Without a device 140, the handle 12 will return to the ON position.

The above description is of one preferred exemplary embodiment of the present invention, and the invention is not limited to the specific forms shown. For example, interference pins 62 could be replaced by a formed tab on side arms 58. This and other modifications may be made in the design and arrangement of the elements within the scope of the invention, as expressed in the appended claims.

We claim:

1. An improved circuit breaker including a circuit breaker housing, first and second terminals attached to the housing, a first stationary contact electrically coupled to the first terminal, a first movable contact electrically coupled to the second terminal, a first link including a first end and a second end, a second link including a third end and a fourth end, and a pivoting member movable between an ON position and an OFF position; wherein the first end is pivotable about a first pivot supported relative to the housing, the second end is rotatably connected to the third end, and the fourth end is pivotably coupled to the movable contact, such that the movable contact engages the stationary contact when the pivoting member is in the ON position and the movable contact is separated from the stationary contact when the pivoting member is in the OFF position; the improvement comprising:

a pin fastened to the pivoting member such that the pin interferes with the first link before the handle mechanism is moved to the OFF position when the first movable contact is restricted from separating from the first stationary contact, wherein the pivoting member is prevented from moving to the OFF position.

2. The circuit breaker of claim 1, wherein the pivoting member supports an operator engagable handle.

3. The circuit breaker of claim 1, wherein the first stationary contact is rigidly mounted to the circuit breaker housing.

4. The circuit breaker of claim 1, further comprising a shaft which pivotally couples the first link to the second link, and an elastic element including a first end portion and a second end portion, wherein the shaft couples the first end portion to the second end of the first link and the second end portion is coupled to the pivoting member.

5. The circuit breaker of claim 4, wherein the elastic element is a tension spring.

6. The circuit breaker of claim 1, further comprising:

a first pivoting contact arm wherein the first movable contact is fixed to the first pivoting contact arm; and a crossbar pivotally attached to the fourth end for pivoting the first contact arm to engage and disengage the first movable contact and the first stationary contact.

7. The circuit breaker of claim 6, further comprising:

a second movable contact for engaging a second stationary contact, wherein the second movable contact is fixed to a second pivoting contact arm; and a third movable contact for engaging a third stationary contact, wherein the third movable contact is fixed to a third pivoting contact arm;

the crossbar being coupled to the second and third pivoting contact arms to engage and disengaged the second and third movable contacts from the second and third stationary contacts.

8. The circuit breaker of claim 1, further comprising:

a cradle pivotable between a first position and a second position about a cradle pivot, the cradle supporting the first pivot and, when in the second position, positioning the first pivot such that the first movable contact is urged to disengage the first stationary contact; and a tripping mechanism which engages the cradle to maintain the cradle in the first position such that the cradle pivots to the second position when the tripping mechanism disengages the cradle.

9. A circuit breaker contact moving mechanism for moving a first movable contact into and out of electrical engagement with a first stationary contact, the mechanism comprising:

a first contact arm including a first end and a second end, the first end being pivotable about a first pivot and the second end being fixed to the first movable contact;

a handle mechanism rotatable about a second pivot between an ON position and an OFF position;

a first link including a first line end and a second link end, the first link end being pivotably coupled to a third pivot;

a second link including a third link end and a fourth link end, the third link end being pivotably coupled to the second link end and the fourth link end being pivotably coupled to the first contact arm;

a tension spring coupled to the handle mechanism and the third link end, wherein the first movable contact is engaged with the first stationary contact when the handle mechanism is in the ON position and the first movable contact is separated from the first stationary contact when the handle mechanism is in the OFF position; and a pin fastened to the handle mechanism such that the pin interferes with the first link before the handle mechanism is moved to the OFF position when the first movable contact is restricted from separating from the first stationary contact such that the handle mechanism is prevented from rotating to the OFF position.

10. The circuit breaker contact moving mechanism of claim 9, further comprising a shaft pivotably coupling the first link and the second link such that the tension spring is coupled between the shaft and the handle mechanism.

11. The circuit breaker contact moving mechanism of claim 9, further comprising a rotating crossbar pivotally coupling the fourth end to the first contact arm.

12. The circuit breaker of claim 11, further comprising a second movable contact for contacting a second stationary contact, and a third movable contact for contacting a third stationary contact, wherein the crossbar pivotally couples the fourth link end to the second movable contact and the third movable contact.

13. The circuit breaker contact moving mechanism of claim 9, further comprising:

a cradle pivotable about a cradle pivot between a first position and a second position, the cradle supporting the third pivot and, when in the second position, positioning the third pivot such that the tension spring urges the first movable contact to disengage the first stationary contact; and a tripping mechanism which engages the cradle to maintain the cradle in the first position such that the cradle pivots to the second position when the tripping mechanism disengages the cradle.

14. An improved circuit breaker including a circuit breaker housing, first and second terminals attached to the housing, a first stationary contact electrically coupled to the first terminal, a first movable contact electrically coupled to the second terminal, a first link including a first end and a second end, a second link including a third end and a fourth end, and a pivoting member movable between an ON position and an OFF position; wherein the first end is pivotable about a first pivot supported relative to the housing, the second end is rotatably connected to the third end, and the fourth end is pivotably coupled to the movable contact, such that the movable contact engages the stationary contact when the pivoting member is in the ON position and the movable contact is separated from the stationary contact when the pivoting member is in the OFF position; the improvement comprising:

a protrusion on the pivoting member which interferes with the first link before the handle mechanism is moved to the OFF position when the first movable contact is restricted from separating from the first stationary contact.

15. The circuit breaker of claim 14, wherein the pivoting member supports an operator engageable handle.

16. The circuit breaker of claim 14, wherein the first stationary contact is rigidly mounted to the circuit breaker housing.

17. The circuit breaker of claim 14, further comprising a shaft which pivotally couples the first link to the second link, and an elastic element including a first end portion and a second end portion, wherein the shaft couples the first end portion to the second end of the first link and the second end portion is coupled to the pivoting member.

18. The circuit breaker of claim 17, wherein the elastic element is a tension spring.

19. The circuit breaker of claim 14, further comprising:

a first pivoting contact arm wherein the first movable contact is fixed to the first pivoting contact arm; and a crossbar pivotally attached to the fourth end for pivoting the first contact arm to engage and disengage the first movable contact and the first stationary contact.

20. The circuit breaker of claim 19, further comprising:

a second movable contact for engaging a second stationary contact, wherein the second movable contact is fixed to a second pivoting contact arm; and a third movable contact for engaging a third stationary contact, wherein the third movable contact is fixed to a third pivoting contact arm;

the crossbar being coupled to the second and third pivoting contact arms to engage and disengage the second and third movable contacts from the second and third stationary contacts.

21. The circuit breaker of claim 14, further comprising:

a cradle pivotable between a first position and a second position about a cradle pivot, the cradle supporting the first pivot and, when in the second position, positioning the first pivot such that the first movable contact is urged to disengage the first stationary contact; and a tripping mechanism which engages the cradle to maintain the cradle in the first position such that the cradle pivots to the second position when the tripping mechanism disengages the cradle.

* * * * *